United States Patent [19]

Ford, Jr.

[11] 4,303,178

[45] Dec. 1, 1981

[54] PORTABLE RECEPTACLE

[76] Inventor: Fisher A. Ford, Jr., 13727 Labrador #B, Houston, Tex. 77047

[21] Appl. No.: 157,676

[22] Filed: Jun. 9, 1980

[51] Int. Cl.[3] ..... B65D 43/20

[52] U.S. Cl. ..... 220/345; 220/90.4; 220/253; 224/273; 224/280

[58] Field of Search ..... 220/90.4, 253, 345, 220/18; 108/44, 46; 222/511, 559; 224/273, 280

[56] References Cited

U.S. PATENT DOCUMENTS

| | | | |
|---|---|---|---|
| 1,613,518 | 1/1927 | Kendall | 220/345 X |
| 2,104,887 | 1/1938 | Rueger | 222/559 |
| 3,187,923 | 6/1965 | Christensen | 220/18 |
| 4,094,433 | 6/1978 | Numbers | 220/90.4 |

FOREIGN PATENT DOCUMENTS

| | | | |
|---|---|---|---|
| 1045553 | 7/1947 | France | 220/345 |

*Primary Examiner*—George T. Hall
*Attorney, Agent, or Firm*—Robert W. B. Dickerson

[57] ABSTRACT

A cylindrical container having combination means for removable access to the interior thereof as well as for positioning said container to another object.

3 Claims, 4 Drawing Figures

FIG. 1
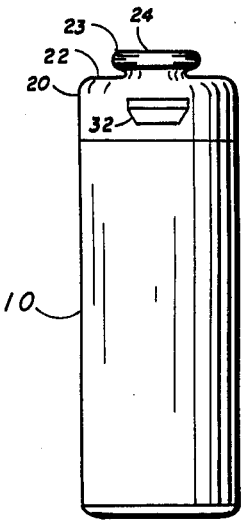
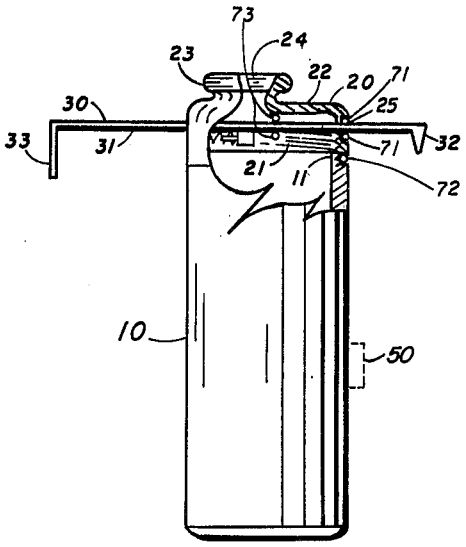
FIG. 2
FIG. 3
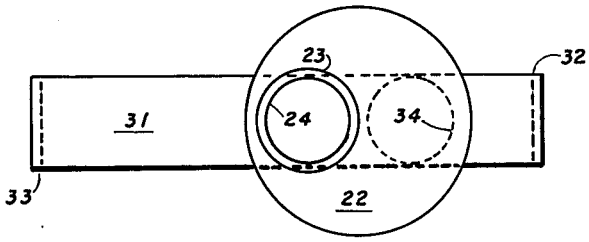
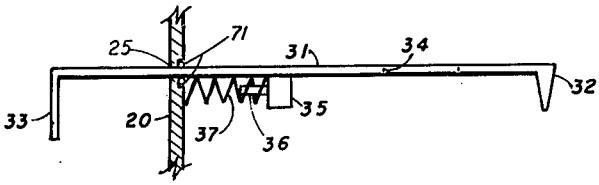
FIG. 4

PORTABLE RECEPTACLE

BACKGROUND OF THE INVENTION

Spittoons have long been used as a receptacle, especially during older days when tobacco was more often chewed than smoked. Such a form of usage has become more common recently. With America's love for automobiles, a need has developed for a receptacle convenient for travel. Uses for such a receptacle include, in addition to chewing tobacco and snuff users, cold sufferers and persons with dental problems. It is to solve such needs that this invention is directed. A search revealed the following U.S. Pat. Nos. 4,057,167 and 1,796,999.

SUMMARY OF THE INVENTION

A cylinder or bottle includes a top aperture, and slidably accommodates a lever. The lever includes an aperture which may align with the cylinder aperture, but is spring biased toward non-alignment.

DESCRIPTION OF THE DRAWINGS

FIG. 1 is an end view of the device;

FIG. 2 is a, partly broken-away, front view;

FIG. 3 is a top elevation; and

FIG. 4 is an end view of the lever and spring.

DESCRIPTION OF A PREFERRED EMBODIMENT

FIGS. 1 and 2 depict the receptacle as including a cylinder or bottle 10 threaded around its upper lip at 11. Threadedly engageable therewith is a cap 20 having threads 21 around its lower skirt. Said cap is open at its lower end, for communication with the interior of bottle 10. The cap further includes top 22, and mouthpiece 23 has an aperture 24 therethrough, for fluid communication with the devices interior. Slidably positioned through oppositely positioned cutouts 25 in cap 20 is lever 30. Said lever includes an elongated central web 31 with oppositely disposed hooks or flanges 32, 33. Toward one end of lever 30 an aperture 34 is positioned, it being approximately the size of cap aperture 24. The underside of lever 30 carries a spring return, generally comprising depending lug 35 and pin extension 36. Surrounding pin 36, and abutting lug 35 is coil spring 37. Said spring also abuts against the interior wall of receptacle cap 20. Annular dynamic seal 73, carried by lever 30, and O-rings 71, 72 positioned within cutouts in bottle 10 and cap 20, prevent leakage of the contents.

OPERATION

While this receptacle may be handcarried, a prime use may be during vehicular travel. A car window may be elevated so as to trap center web 31 between the glass and the auto frame, or flange 33 may be inserted in the window well intermediate the window glass and car frame, adjacent a user. Normally, apertures 24, 34 are mis-aligned. On exerting a force against hook or grasping member 32, the lever 30, against the force of spring 37 may align such apertures so as to permit effective use. On completion, the spring will return the lever to its FIG. 1 position. If desired, magnet 50, shown in phantom lines in FIG. 2, may be affixed to the bottle portion to permit fixing the device to any exposed metallic portion of the vehicle.

Although only a single embodiment has been described, it should be obvious that numerous modifications would be possible by one skilled in the art without departing from the spirit of the invention, the scope of which is limited only by the following claims.

I claim:

1. A portable sputum receiving receptable comprising:

a cylindrical, open ended, fluid receiving body, having means at its open end for receiving a cap;

a hollow, open ended, cap member removably affixed to the open end of said body, said cap member comprising a cylindrical skirt, a top, a sputum receiving aperture through said top and oppositely positioned cutouts in said skirt;

a slidable lever extending through and outwardly of both said cap cutouts, said lever having (a) an aperture therethrough normally misaligned with said cap aperture, (b) a pressure receiving flange at one end for permitting a force to cause sliding of said lever thereby aligning said cap and lever apertures, and (c) means for fixedly positioning said lever to a car window, said positioning means comprising a flange depending and approximately normal to said lever at its other end, whereby said flange may be inserted intermediate the window glass and frame; and spring means for biasing said lever toward a position wherein said cap and lever apertures are misaligned.

2. The receptacle of claim 1 and including seal means for preventing sputum entering said cap aperture from laterally leaking from said receptacle.

3. The receptacle of claim 2 wherein said seal means comprises a dynamic O-ring on said lever intermediate the side of said lever aperture nearest said positioning means and static O-rings on both side of said cap cutouts.

* * * * *